US006438963B1

(12) United States Patent
Traver et al.

(10) Patent No.: US 6,438,963 B1
(45) Date of Patent: Aug. 27, 2002

(54) LIQUID FUEL AND WATER INJECTION PURGE SYSTEMS AND METHOD FOR A GAS TURBINE HAVING A THREE-WAY PURGE VALVE

(75) Inventors: Robert Scott Traver, Ballston Lake; Robert Joseph Iasillo, Ballston Spa; Howard Jay Kaplan, Clifton Park, all of NY (US); Troy Joseph Schroeder, Mauldin, SC (US); Christopher John Morawski, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/653,538

(22) Filed: Aug. 31, 2000

(51) Int. Cl.[7] ..... F02C 7/232; F02C 9/40; F02C 6/08

(52) U.S. Cl. ..... 60/779; 60/39.094; 60/39.463

(58) Field of Search ..... 60/39.02, 39.094, 60/39.463, 739, 779, 785, 39.05

(56) References Cited

U.S. PATENT DOCUMENTS

| | | | | | |
|---|---|---|---|---|---|
| 5,095,694 | A | | 3/1992 | Shekleton et al. | 60/39.094 |
| 5,417,054 | A | * | 5/1995 | Lee et al. | 60/39.094 |
| 6,050,081 | A | * | 4/2000 | Jansen et al. | 60/39.094 |
| 6,145,294 | A | * | 11/2000 | Traver et al. | 60/39.094 |
| 6,145,318 | A | * | 11/2000 | Kaplan et al. | 60/39.094 |

FOREIGN PATENT DOCUMENTS

| | | | | |
|---|---|---|---|---|
| GB | 0664245 | * | 1/1952 | 60/39.094 |

* cited by examiner

*Primary Examiner*—Ted Kim
(74) *Attorney, Agent, or Firm*—Nixon & Vanderhye P.C.

(57) ABSTRACT

A liquid fuel purge system is disclosed for flushing liquid fuel from the combustion chambers of a gas turbine. The liquid purge system includes a three-way valve to pass liquid fuel and, alternatively, purge air to the combustion chambers. The gas turbine may operate on liquid fuel or gaseous fuel. When the turbine is switched to burn gaseous fuel, the liquid fuel remaining in the liquid fuel system is flushed by purge air provided by a liquid fuel purge system.

30 Claims, 5 Drawing Sheets

LIQUID FUEL AND WATER INJECTION PURGE SYSTEMS AND METHOD FOR A GAS TURBINE HAVING A THREE-WAY PURGE VALVE

BACKGROUND

The field of the invention relates to gas turbines, and, in particular but not limited, to liquid fuel injection systems for industrial gas turbines.

Industrial gas turbines are often capable of alternatively running on liquid and gaseous fuels, e.g., natural gas. These gas turbines have fuel supply systems for both liquid and gas fuels. The gas turbines generally do not burn both gas and liquid fuels at the same time. Rather, when the gas turbine burns liquid fuel, the gas fuel supply is turned off. Similarly, when the gas turbine burns gaseous fuel, the liquid fuel supply is turned off. Fuel transitions occur during the operation of the gas turbine as the fuel supply is switched from liquid fuel to gaseous fuel, and vice versa.

Gas turbines that burn both liquid and gaseous fuel require a liquid fuel purge system to clear the fuel nozzles in the combustors of liquid fuel. The liquid fuel supply system is generally turned off when a gas turbine operates on gaseous fuel. When the liquid fuel system is turned off, the purge system operates to flush out any remaining liquid fuel from the nozzles of the combustor and provide continuous cooling airflow to the nozzles.

FIG. 1, shows schematically a gas turbine 100 having liquid fuel system 102 and a liquid fuel purge system 104. The gas turbine is also capable of running on a gas, such as natural gas, and includes a gaseous fuel system 106. Other major components of the gas turbine include a main compressor 108, a combustor 110, a turbine 112 and a controller 114. The power output of the gas turbine is a rotating turbine shaft 116, which may be coupled to a generator that produces electric power.

In the exemplary industrial gas turbine shown, the combustor may be an annular array of combustion chambers, i.e., cans 118, each of which has a liquid fuel nozzle 120 and a gas fuel nozzle 122. The combustor may alternatively be an annular chamber. Combustion is initiated within the combustion cans at points slightly downstream of the nozzles. Air from the compressor 108 flows around and through the combustion cans to provide oxygen for combustion. Moreover, water injection nozzles 111 are arranged within the combustor 110 to add energy to the hot combustion gases and to cool the combustion cans 118.

FIG. 2 shows a conventional liquid fuel purge system 104 for a liquid fuel system. When the gas turbine 100 operates on natural gas (or other gaseous fuel), the liquid fuel purge system 104 blows compressed air through the nozzles 120 of the liquid fuel 102 system to purge liquid fuel and provide a flow of continuous cooling air to the liquid fuel nozzles 120.

The air used to purge the liquid fuel system is supplied from a dedicated motor (M) controlled purge compressor 128. The purge compressor boosts the compression of air received from the main compressor 108 via compressor discharge 202. A compressor air pre-cooler 164, separator 166 and filter 168 arrangement is used to treat the compressor air before it is boosted by the purge compressor 128. A tuning orifice 132 meters the flow of purge. The purge air from the purge compressor is routed through piping 130, a strainer 162, a Tee 137 that splits the purge airflow between the liquid fuel purge system 104 and a water purge system 126. A liquid fuel purge multiport valve 138 routes the boosted pressure purge air to each of the liquid fuel nozzles 120. The multiport valve is controlled by a solenoid 139 that is operated by the controller 114. At each combustion chamber, end cover check valves 147 prevent liquid fuel from back flowing into the purge system. In addition, the purge compressor provides air through another tuning orifice 133 to an atomizing air manifold 134 and to the atomizing air ports of the liquid fuel nozzles 120.

The liquid fuel check valves 165, at least one for each combustion chamber, isolate the liquid fuel supply 172 during purge operations and prevent purge air from back-flowing into the liquid fuel system. By preventing purge air from entering the liquid fuel system, the check valves avoid air-fuel interfaces with the fuel supply.

When the liquid fuel purge system 104 is initiated, a solenoid controlled soft purge valve 140 is open simultaneously with the multiport valve 138 by a common solenoid valve 139. The soft purge valve 140 opening rate is mechanically controlled by a metering valve in an actuation line (not shown). The soft purge valve opens over a relatively long duration of time to minimize load transients resulting from the burning of residual liquid fuel blown out into the combustor from the purge system piping 142 and the liquid fuel nozzles. The soft purge valve 140 is a low flow rate valve, to reduce the boosted pressure purge air flowing from the purge compressors. After the soft purge valve has been opened a predetermined period of time, a high flow purge valve 144 is opened to allow the boosted purge air to flow at the proper system pressure ratio. The high flow purge valve may be a two-way ball valve 144.

The above-described piping, valves, purge compressor and other components of the liquid fuel purge system are complicated and cumbersome. The system requires controlled opening of several valves, multiport valves, metering tuning orifices, check valves, all of which require maintenance and are possible failure points. If the purge system fails, component failures will likely go undetected until turbine operation is ultimately affected, at which time the turbine must be taken off-line and serviced. To avoid having to take a gas turbine off-line due to a purge system failure, the conventional wisdom has been to add more purge system components and to add a backup system to the main purge system.

For example, if the purge compressor 128 fails, then air for the purge systems is supplied from an atomizing air compressor 150 and cooled in a purge air cooler 152. When the atomizing air compressor operates to provide air for the purge systems, then motor (M) operated valves 154, 156, are closed to reduce flow and pressure, and air is routed through the purge cooler at the appropriate pressure and temperature. In addition, motor operated valve 158 is opened to provide a surge protection feedback loop. The operation of these valves 154, 156 and 158 controls the air flow to and from the atomizing air compressor 150.

Purge air from the atomizing air or purge air compressor passes through a strainer 162 to remove contaminants from the purge air and protect the contaminant sensitive components from start up and commissioning debris. The purge cooler 152 is in addition to the precooler 164, separator 166 and filter 168 used to cool air from the main compressor 108.

The previously-described conventional liquid fuel purge system has long suffered from several disadvantages and is prone to failure. To overcome the disadvantages of prior systems, the conventional wisdom has been to regularly redesign the components of the purge system, especially those components, e.g., check valves 147 and multiport valve 138, that are prone to failure due to contaminants in the purge air.

Check valves do not provide optimal isolation of the purge and fuel systems. When they fail in an open position, purge check valves allow fuel to leak into the purge system. When purge check valves fail closed, purge air does not reach the fuel nozzles, and nozzle coking and melting can occur. When a fuel check valve fails in a closed position, it prevents fuel flow to a nozzle and can create pressure head differences in the fuel system between the combustors. Failure of the fuel check valves (either open or closed) may also lead to ignition and cross-fire failures and damage to the fuel system upstream of the fuel check valves. When they fail in an open position, fuel check valves may allow purge air to bubble into the fuel system. Check valve failures lead to serious combustion problems and may force the gas turbine to be shut down for repair.

Liquid fuel check valves do not provide bubble tight isolation against purge air pressure which results in a liquid fuel/air interface. This fuel/air interface results in "coking" of the liquid fuel and, thus, fouling of the liquid fuel check valves and fuel nozzles. Fouling, and in some cases plugging, of the fuel nozzles disrupts fuel flow and eventually results in high temperature spreads at which point the turbine can no longer operate on liquid fuel. The leaking check valves also allow air entrapment and back-flow of purge air into the liquid fuel system. These problems can result in false starts and can prevent gas to liquid fuel transfers during gas turbine operation. In addition, utilizing two separate components may result in improper isolation and cause the purge system to be partially back filled with liquid fuel. If the liquid fuel seeps into the purge system, the fuel may experience coking that results in blockage of the fuel nozzles, a reduction in the required purge flow and thus premature failure of the liquid fuel nozzles due to lack of purge cooling. Fuel in the purge system may also cause ignition and cross-fire failures resulting in combustion spreads between the cans and ultimately tripping of the gas turbine unit.

Moreover, functioning fuel check valves may require substantial fuel pressure to open and allow fuel to pass. The pressure required to operate the liquid fuel check valve increases the load on the fuel pump. The added load on the pump may require larger fuel pumps and/or purge compressors than would otherwise be needed.

The conventional purge control method has been to utilize a series of tuning orifices to balance the purge air and to set the appropriate pressure ratios for acceptable combustion dynamics. These tuning orifices have had to be individually sized to adjust the pressure ratios of the purge air. Furthermore, the conventional purge systems require subsystems, such as a soft purge valve 140 with tuned needle valves, for initial application of purge air to the nozzles of the liquid fuel system. The soft purge valve was added to minimize transient load spikes during fuel transfers when the purge systems are started.

With the addition of purge compressors, backup systems for the purge compressors, tuning orifices, strainers, subsystems and other new components, instrumentation had to be added to protect the new components against contamination. These fixes to the purge systems were marginally acceptable. The conventional purge air systems, with all of their fixes and new components, were complex, delicate and not adequately reliable.

SUMMARY OF THE INVENTION

Applicants designed a novel fuel purge system for a gas turbine that includes a three-way liquid fuel purge valve. The three-way valve simplifies the purge system by replacing the prior two-way purge valves, check valves, poppet multiport valves, Tee junctions and other components of prior liquid fuel purge systems. At least one three-way valve couples both the liquid fuel supply and the purge air system to an end cover of each combustion chamber can. The valve switches the flow of purge air to the fuel nozzles to liquid fuel flow, and vice versa. The three-way valve retains less liquid fuel volume, e.g., 22% less, than does the equivalent combination of a two-way liquid fuel purge end-cover isolation valve (or a purge check valve), liquid fuel check valve and Tee-assembly. The lower fuel volume in the valve reduces the volume of liquid fuel to be purged and thereby reduces the transition magnitude when switching from liquid to gaseous fuel.

In addition, the three-way valve prevents back-flow or purge air into the liquid fuel system, and vice versa. Back-flow was previously prevented by liquid fuel check valves that are prone to coking (a condition where internal air passages that are exposed to fuel become varnished with fuel residue) and contamination. Similarly, the prior poppet-type multiport valve, purge isolation valves and fuel check valves were adversely affected by contaminants in the purge air. The three-way valves also eliminate (or at least markedly reduce) the potential of liquid fuel back-flow into the purge air manifold during liquid fuel operation, and especially during fuel transitions.

The three-way valve system has passive and active modes. During the active mode, the valve is controlled by external signals, such as instrument air pressure applied by the gas turbine controller. In passive mode, the valve is controlled by the pressure of the liquid fuel. The passive mode is used to switch the valve between purge air flow and purge liquid fuel flow. The active mode is applied to hold the valve in a liquid fuel ON flow setting during high fuel-flow conditions. The active mode is not used to switch the valve from fuel flow to purge air, or vice versa. The valve is biased to purge air flow, if there is insufficient fuel pressure present to operate the valve.

The advantages provided by passive/active modes include providing uniform back pressure to the liquid fuel system to balance pressure head differences between combustor cans, minimizing the risk that hot fuel nozzles lose both cooling air and liquid fuel flows simultaneously, reducing the pressure demand on liquid fuel pumps, providing fail-safe valve operation, minimization of purge system components and improved reliability.

In the present invention, the three-way valves (operating in the passive mode) automatically switch to pass fuel to the nozzles when the fuel pressure increases. The fuel pressure increase is the actuating force that switches the valve from applying purge air to applying liquid fuel flow to the fuel nozzles. Pressure head differences (and the corresponding pressure induced stresses) in the liquid fuel system are minimized by eliminating the potential that a fuel check valve fails open or closed. Accordingly, there is minimal risk that excessive pressure head differences between the combustors will occur in the liquid fuel system because of a spool type three-way valve that replaces the failure prone poppet type check valves.

The need for large, high pressure liquid fuel pumps is reduced because the check valves are no longer needed that had applied substantial back pressure to fuel pumps. In the past, high pressure check valves were actuated by high fuel pressure and, thus, increased the load on the fuel pump. The size of a fuel pump is dependent on the required fuel pressure, especially during high fuel-flow conditions. To remain open to fuel flow, check valves applied substantial back pressure to fuel pumps, including during high fuel flow conditions. The fuel pressure needed to operate the three-way valve of the present invention is less than the pressure required to open the prior high pressure check valves. Moreover, during high liquid fuel-flow conditions, the three-way valve of the present invention is in active switch mode such that instrument air is applied to the valve actuator. High liquid fuel pressure is not needed to operate the valve when in active mode. Since the fuel pump is not required to operate the valve during high fuel flow mode, smaller (and hence more economical) fuel pumps may be used. These smaller fuel pumps are sufficient to provide the fuel pressure needed to operate the three-way valve during passive mode.

The purge system of the present invention is simple, robust, reliable and cost effective. This system provides a continuous and reliable flow of purge air to flush the nozzles for liquid fuel and water injection free of liquids, and to cool the nozzles. In addition, the three-way valve of the purge system prevents back-flow of hot combustion products into the liquid fuel system. Furthermore, when the fuel system is on, it is isolated from the purge system by the three-way valve to prevent accumulation of fuel in the purge system.

Further, advantages provided by the purge system of the present invention include enhanced reliability in the operability of the liquid fuel systems for gas turbines, and improved transient attributes of purge systems during liquid fuel to gas fuel transitions. The inventive purge system provides a continuous flow of purge air to flush liquid fuel from fuel nozzles, to cool the nozzles and prevent back-flow through the nozzles and liquid fuel manifold of hot combustion products when liquid fuel is not flowing. In the present invention the purge and liquid fuel systems work together to prevent back-flow of purge air into the liquid fuel system to prevent liquid fuel "coking" and air entrapment in the liquid fuel system when liquid fuel is not flowing through the fuel system. The purge system also provides isolation when liquid fuel is flowing by preventing the accumulation of liquid fuel in the purge system.

The inventive purge system with three-way valve may operate with lower pressure air from the main compressor discharge, i.e., a compressor-less purge system, and does not require a separate purge compressor to boost the pressure of the purge air while the gas turbine operates on gas fuel. The main compressor is inherently reliable, at least in the sense that the gas turbine cannot operate when the main compressor is inoperable. In addition, the atomizing air compressor is not needed as a back-up boost pressure system while the gas turbine is on gas fuel. To accommodate the lower pressure purge air, the purge air piping may have increased diameters to allow for greater purge air flow volume. In addition, the present purge system includes a purge manifold to distribute purge air to the liquid fuel nozzles. This manifold replaces the complex multiport poppet valve used on conventional purge systems.

Other novel features of the present invention include true block-and-bleed capability which provides double valve isolation with an inter-cavity vent for improved reliability, and a single point tuning control valve that allows adjustments to be easily made to the pressure ratio required for minimum combustion dynamics.

DETAILED DESCRIPTION OF THE DRAWINGS

Figure 1:
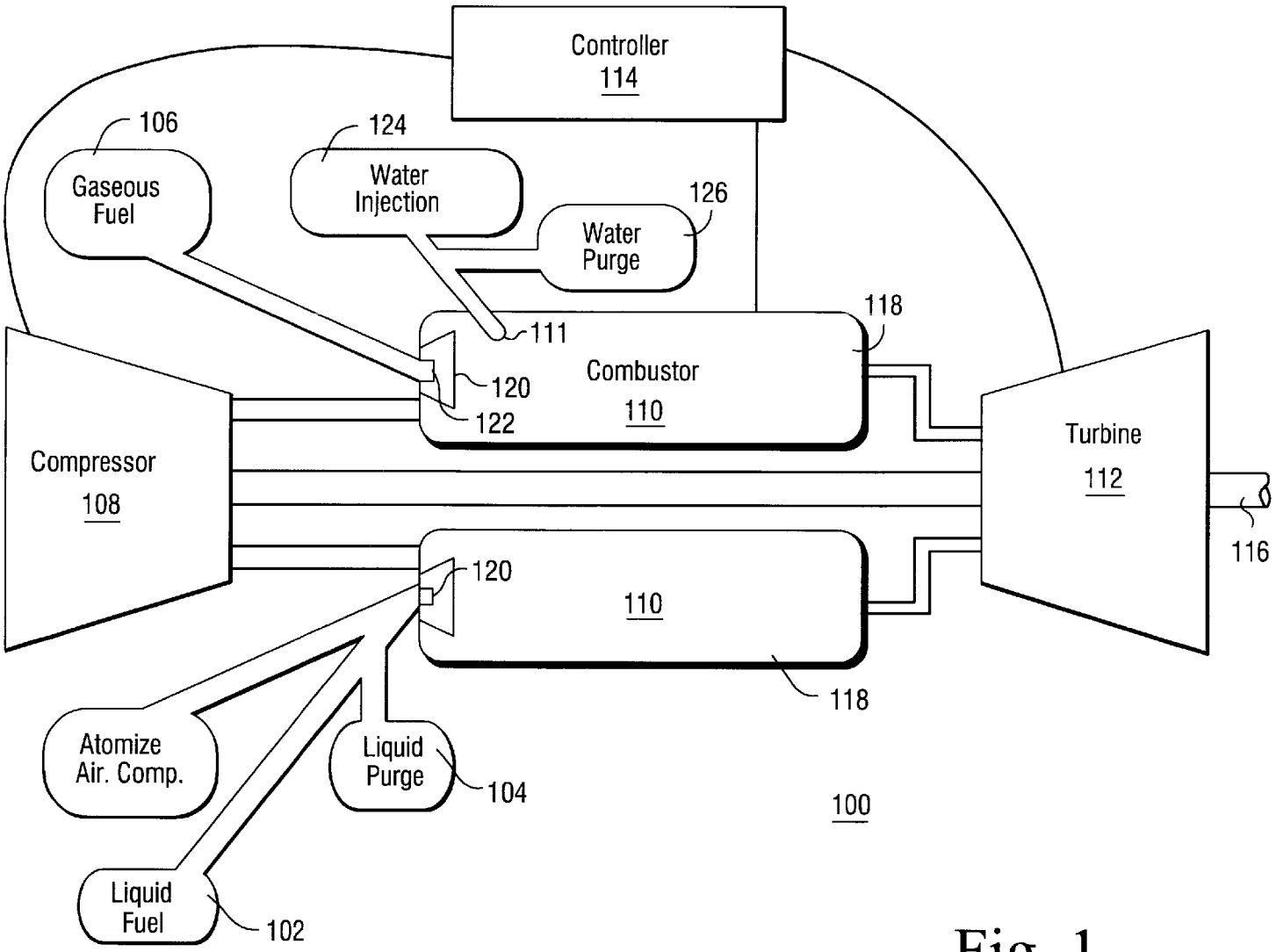
FIG. 1 is a schematic diagram of an exemplary gas turbine having liquid fuel and water injection purge systems.
Figure 2:
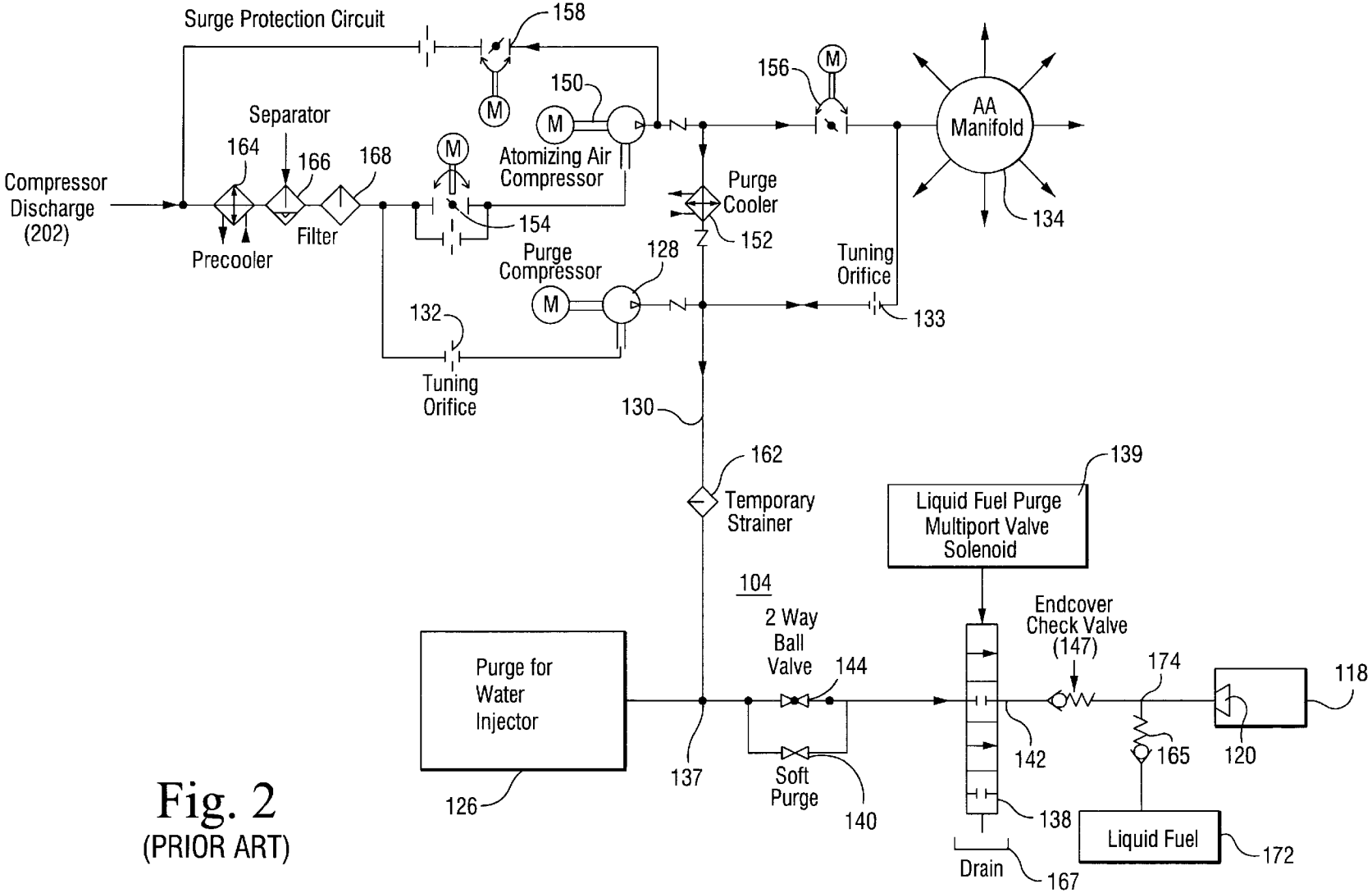
Fig. 2 (PRIOR ART)
FIG. 2 is a diagram showing schematically a conventional liquid fuel and water injection purge system.
Figure 3:
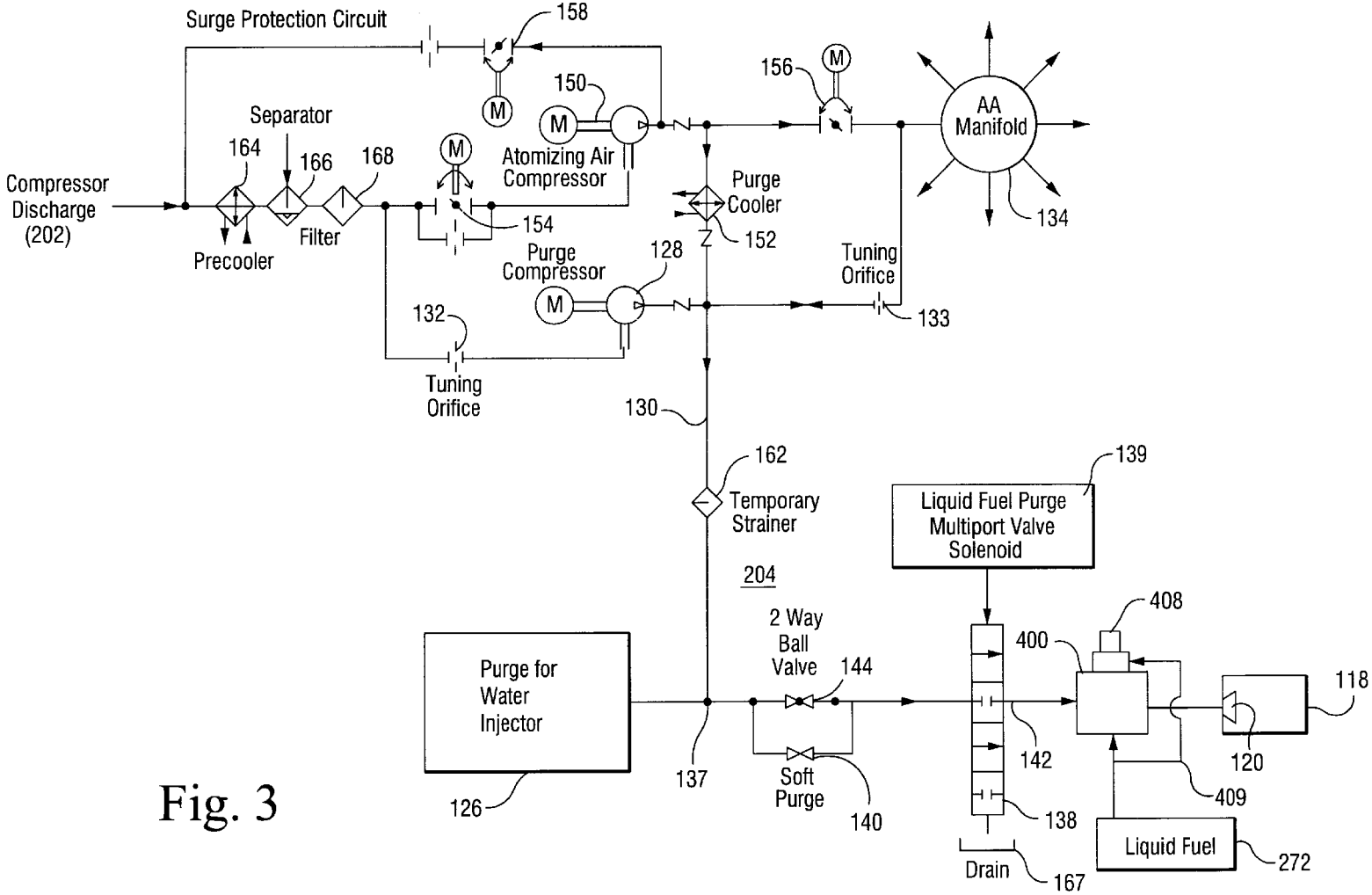
FIG. 3 is a diagram showing a purge system for liquid fuel that utilize a purge compressor.

FIG. 3 shows an exemplary purge system 204 that embodies the present invention and can be implemented on the gas turbine system shown in FIG. 1. The purge system 204 is similar to the purge system 104 described in connection with FIG. 2. However, the purge system 204 may include a liquid fuel purge manifold (see 234 in FIG. 4) and a three-way valve 400 that replaces the multiport poppet valve 138 (optional replacement), two-check valves 147, 165, and the Tee 174 of the purge system 104 shown in FIG. 2. The three-way valve 400 provides liquid fuel or, alternatively, purges air to the fuel nozzles 120 of each combustion chamber 118. There is, preferably, at least one three-way valve 400 for each chamber 118. The valve includes input couplings to receive liquid fuel from the fuel supply 272 and purge air from the multiport purge air valve 138. The valve and its operation are further described in connection with FIG. 5.

Figure 4:
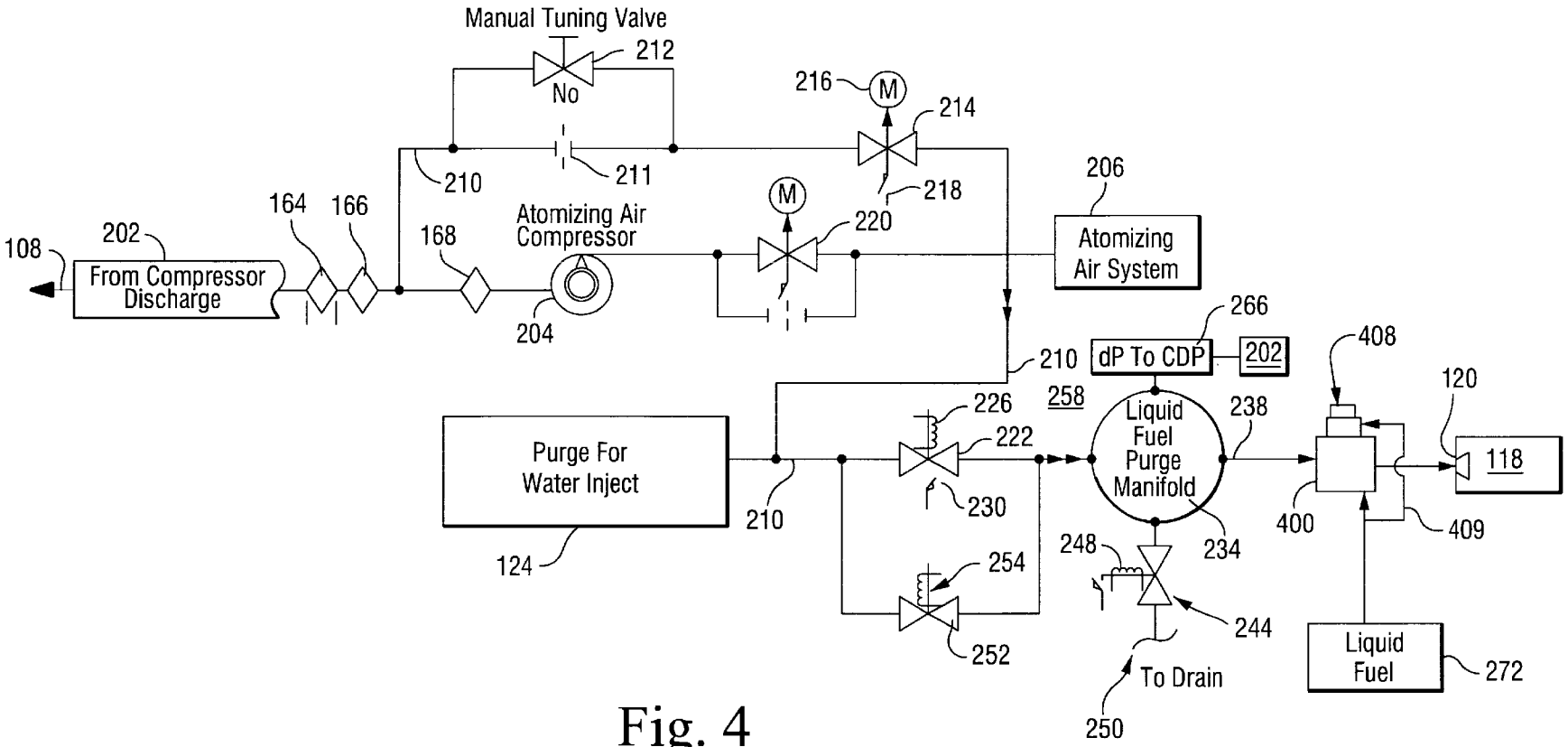
FIG. 4 is a diagram showing an alternative purge system which does not utilize purge compressor.

FIG. 4 shows an alternative implementation of a three-way valve that uses purge air that has not been boosted by a purge compressor. The purge system receives cooled and filtered air from a compressor discharge port 202 of the main compressor 108. Air from the compressor passes through the atomizing air precooler 164, separator 168, moisture separator 166 and a purge compressor 128. The by-pass line may include a manual tuning valve 212 and a restriction orifice 211 that provides manual control over the pressure and flow rate of the compressor discharge air being supplied as purge air to the purge system. The pressure of the purge air is no greater than the pressure of the compressor air from port 202, because the purge system does not require a booster purge compressor.

The compressor discharge 202 used by the purge system is shared with the atomizing air compressor 204 that supplies boosted atomizing air to the liquid fuel nozzles via an atomizing air system 134 and to the atomizing air ports of the liquid fuel nozzles. The atomizing air compressor and, in particular, the pressure ratio for atomizing air, are controlled by motor operated valves 214 and 220, that are operated by controller 114. While the gas turbine burns gaseous fuel, the compressor discharge air 202 bypasses the inactive atomizing air compressor since the motorized valve 220 has been closed and the motor 126 actuated bypass valve 214 has been opened.

The main compressor discharge 202 is an inherently reliable air source. Purge air flows through the bypass line 210 to the main purge feed valve 222 for purging the liquid fuel. These main feed valves are normally open, with the amount of purge air flowing through the valves depending on the settings of the main bypass valve 214 and the atomizing air valve 220. The flow of purge air starts when valve 214 is opened, such as during a transition from burning liquid fuel to gaseous fuel in the combustor.

Online adjustment of the purge pressure ratio is provided by a manual tuning valve 212 that can be manually closed to restrict and adjust the purge flow with the purge systems online. Because the purge flow can be controlled online, the mechanical components of the purge system may be designed with a generous flow margin above the specific flow margin to which the system is designed. During operation of the purge system, the manual flow valve 212 can be tuned down to a precise purge flow rate to minimize any adverse combustion effects, such as on combustion dynamics or flame stability.

The purge feed valve 222 is controlled with a solenoid 226. The solenoid is operated by the controller 114 and limit switch 230 prevents the valve 222 from exceeding certain operating limits.

A purge manifold 234 is downstream of the purge feed valve 222 distributes purge air to each combustion chamber 118. Purge lines 238 extend from the purge manifold 234 to a three-way valve 400 for each combustion chamber.

Soft purge functions are provided by (normally closed) small, low flow feed valve 252 associated with the purge air manifold 234. This soft purge valve is in parallel with the main purge feed valve 222. The soft purge feed valve 252 is operated by solenoid 254 for soft purge flow introduction, under the control of controller 114.

The small soft purge feed valve 252 restricts the flow of purge air to the liquid fuel manifold 234 and fuel nozzles during the initiation phase of purging the liquid fuel system. The soft purge feed valve slowly meters the introduction of purge air to the fuel nozzles to avoid too strongly flushing liquid fuel out of the nozzles and into the combustion cans to minimize transient power surges in the turbine and to reduce the risk of combustion flame out. The independently controlled components of the double block-and-bleed system provide greater flexibility in all aspects of purge system operation, than was available in prior systems.

When liquid fuel is flowing to the combustion system of the gas turbine, the liquid fuel purge system 258 is inoperative, and the three-way valves 400 for each combustion chamber prevent backflow of fuel into the purge system. These valves 400 pass fuel from the fuel supply 272 to the cans 118. During liquid fuel operation, the main purge feed valve 222 for the liquid fuel purge system 258, is also closed. The drain valve 244 to the manifold is open to allow any purge air or fuel leakage that reaches the liquid fuel manifold to drain out of the gas turbine.

The purge air pressure is monitored in the purge system at the manifold 234. The pressure in the manifold is monitored by comparing (dp) the compressor discharge pressure (CDP) at port 202 with the pressure in the manifold. A delta pressure transducer 266 is connected to the manifold. The transducer is used by the controller 114 to calculate a pressure ratio relative to the compressor discharge pressure. An alarm is provided in the event the ratio falls below a preset limit, and there is an action taken if the ratio falls farther below a preset limit. A possible action will be to take the gas turbine off line to protect the nozzles. The delta pressure transducer attached to the manifold 234 also tracks the manifold pressures to control the operation of the soft purge valve 252 and soft purge operation during purge start-up. The controller 114 opens the valve 252 when the pressure ratio is at a pre-set low level.

Figure 5:
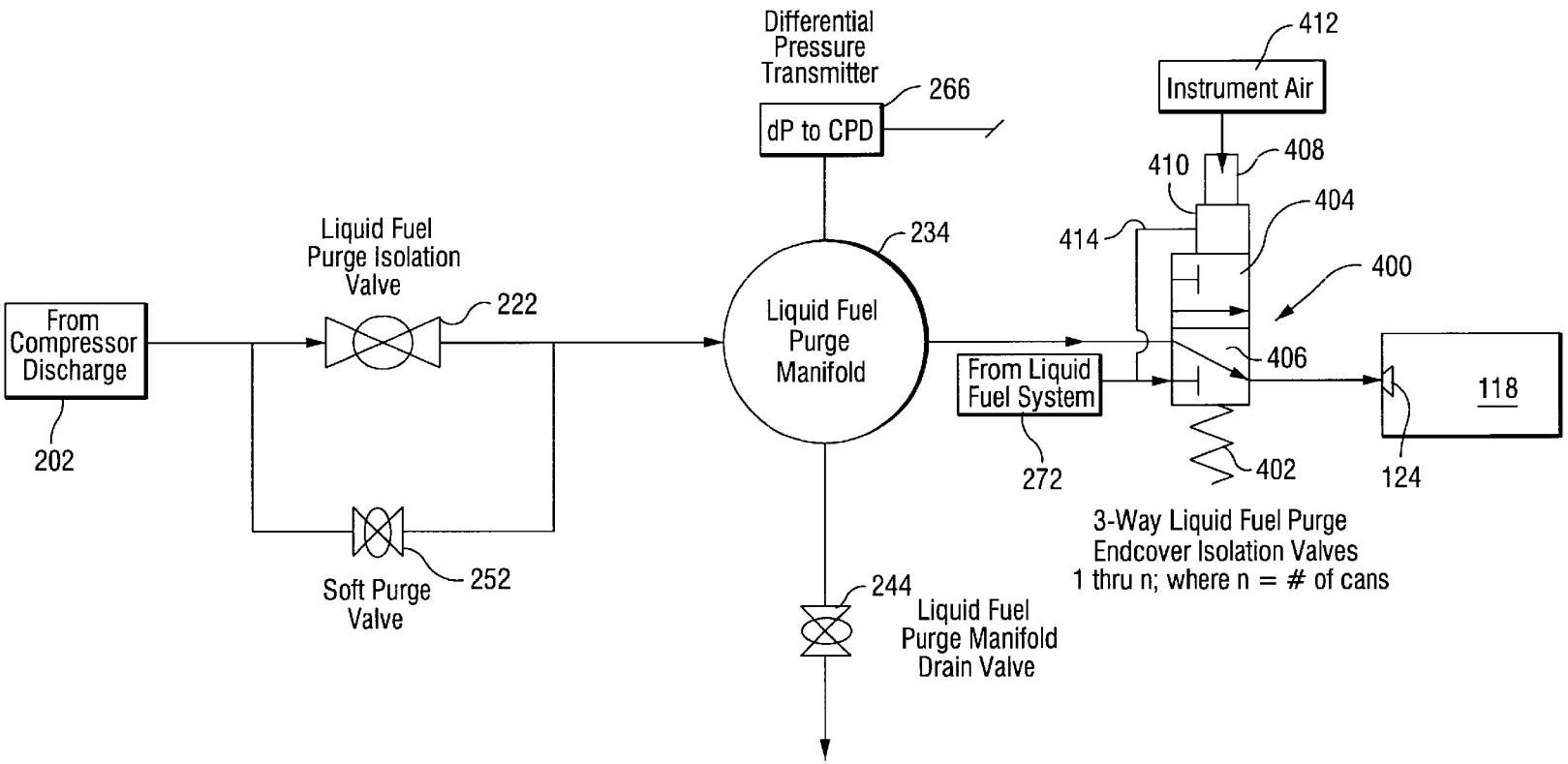
FIG. 5 is a schematic diagram of a three-way valve in a liquid fuel purge system.

FIG. 5 schematically shows a three-way valve 400. The umber of valves 400 per gas turbine vary with frame size and combustion system. Typically, there are 1 to 20 combustion cans per turbine, and one valve 400 per liquid fuel stream (there may be one, two or more fuel streams to the fuel nozzles of each can). The three-way liquid fuel purge valve 400 combines the functionality of a liquid fuel check valve and liquid fuel purge end-cover isolation valve (or purge check valve) into one valve component.

The valve 400 includes a spring 402 that biases the valve to the purge open (ON) position. The valve 400 has a fuel supply passage 404 which forms a conduit for the liquid fuel supply 272 to pass fuel to the combustion end-cover and nozzles of each combustor 118. The valve has a purge air passage 406 which is a conduit for purge air to pass to the combustion end-covers and fuel nozzles. The valve is coking resistant and its fuel passages 404 avoid static pockets of fuel within the valve that might otherwise occur during and between liquid fuel operations. Similarly, the valve eliminates (or at least minimizes) air-fuel contact areas within the valve.

The valve 400 is alternatively switched between the fuel supply passage 402 and purge passage 404 under the control of a valve actuator which includes an active actuator 408 and a passive actuator 410. The passive actuator is responsive to instrument air 412 that is controlled by controller 114 (FIG. 1). In addition, the passive actuator is operated by liquid fuel pressure applied by the liquid fuel supply line 414 from the liquid fuel supply. The valve 400 closes the purge air passages and opens the liquid fuel passage (fuel ON) upon pressurization of the fuel system which passively actuates the valve. In contrast, pressurization of the purge air system and the associated de-pressurization of the fuel system switches the valve to allow purge air to flow (purge ON) and to close the fuel passage, by virtue of the bias spring 402.

A feature of the three-way valve 400 is that one passage (fuel passage 404 or purge air passage 406) of the valve is completely closed-off before another passage (406 or 404) through the valve is opened. The valve 400 also provides a bubble tight (class VI) seal against air leakage back into the liquid fuel system and liquid fuel leakage back into the purge system.

When the liquid fuel pressure is low (such as when the liquid fuel supply is turned off), the three-way valve 400 is biased 402 to a purge air setting, and the valve passes purge air to the fuel nozzles. When the liquid fuel system applies fuel to the combustor, the pressure of the liquid fuel switches the valve from applying purge air to applying liquid fuel to the nozzles. Because the valve is switched by the application of liquid fuel pressure, the liquid fuel flows immediately after valve switching to the fuel nozzles and there is minimal risk that hot fuel nozzles will see a loss of both cooling purge air and cooling liquid fuel flow. In contrast, systems that employed a two-way valve that was externally operated suffered a delay, e.g., 1 to 4 seconds, in switching to purge flow. This delay has been eliminated by use of the three-way valve.

During high liquid fuel-flow conditions, the valve 400 is in active mode such that instrument air 412 is applied to the valve actuator 408. In the active mode, higher liquid fuel pressure is not required to activate the valve or to hold it in a liquid fuel ON setting. Because high liquid fuel pressure is not needed to operate the valve, the liquid fuel pump is not required to provide substantial fuel pressure for the valve (as had been required for certain check valves).

The invention has been described in connection with the best mode now known to the inventors. The invention is not to be limited to the disclosed embodiment. Rather, the invention covers all of various modifications and equivalent arrangements included within the spirit and scope of the appended claims.

What is claimed is:

1. A gas turbine comprising:

a main compressor, a combustor and a turbine;

a liquid fuel supply coupled to provide liquid fuel to the combustor;

a gaseous fuel supply coupled to provide gaseous fuel to the combustor;

a liquid fuel purge system further comprising:

a purge manifold;

a coupling to a compressor air discharge port of the main compressor to draw compressor air into the purge system;

a conduit between the discharge port and the purge manifold through which passes compressor air to the purge manifold, and a valve alternatively coupling the manifold and liquid fuel supply to the combustor, said valve including an actuator coupled to said fuel supply, and said valve having a purge setting in which purge air passes through the valve to the combustor and a liquid fuel setting in which liquid fuel passes through the valve to the combustor, wherein said valve has a passive switch mode in which said valve is switched to said fuel setting by liquid fuel pressure applied to said actuator and an active switch mode in which said valve is maintained in said fuel setting, during a high fuel flow condition, by an external force applied to the actuator.

2. A gas turbine as in claim 1 wherein the valve is a three-way valve.

3. A gas turbine as in claim 1 wherein the purge setting is a valve default setting.

4. A gas turbine as in claim 1 wherein the conduit provides compressor air to the purge manifold at a pressure no greater than a pressure at the compressor air discharge port.

5. A gas turbine as in claim 1 wherein valve further includes a spring providing a bias towards said purge setting and said fuel pressure applied to said actuator is sufficient to overcome said bias.

6. A gas turbine as in claim 5 wherein the valve includes an active actuator coupled to instrument air.

7. A gas turbine as in claim 1 wherein said external force is pressure from instrument air applied to said actuator.

8. A gas turbine comprising:

a main compressor, a combustor and a turbine;

a liquid fuel supply coupled to provide liquid fuel to the combustor;

a gaseous fuel supply coupled to provide gaseous fuel to the combustor;

a liquid fuel purge system further comprising:

a purge manifold;

a coupling to a compressor air discharge port of the main compressor to draw compressor air into the purge system;

a conduit between the discharge port and the purge manifold through which passes compressor air to the purge manifold, a valve alternatively coupling the manifold and liquid fuel supply to the combustor, said valve including an actuator coupled to said fuel supply, and said valve having a purge setting in which purge air passes through the valve to the combustor and a liquid fuel setting in which liquid fuel passes through the valve to the combustor, wherein said valve is switched to said fuel setting by liquid fuel pressure applied to said actuator, wherein valve further includes a spring providing a bias towards said purge setting and said fuel pressure applied to said actuator is sufficient to overcome said bias, and wherein the fuel setting blocks purge air from flowing to the combustor, and the purge setting blocks liquid fuel from flowing to the combustor.

9. A gas turbine comprising:

a main compressor, a combustor with a plurality of combustion chambers, and a turbine;

a liquid fuel supply providing liquid fuel to the combustor;

a liquid fuel purge system including a purge manifold and a source of purge air coupled to the purge manifold, and a plurality of valves, each of said valves alternatively coupling the purge manifold and the liquid fuel supply to one of the combustion chambers, said valves each including an actuator coupled to said fuel supply, and each of said valves having a purge setting in which purge air passes through the valve to the combustor and a fuel setting in which liquid fuel passes through the valve to the combustor, wherein the valve has a passive mode in which said valve is switched to said fuel setting by liquid fuel pressure applied to the actuator and said valve has an active mode in which said valve is maintained in said fuel setting by an external force applied to the actuator.

10. A gas turbine as in claim 9 wherein the valve is a three-way valve having a first input port coupled to the liquid fuel supply, a second input port coupled to the purge manifold and an output port coupled to one of the combustion chambers.

11. A gas turbine as in claim 9 wherein the valve has a first passage coupling the liquid fuel supply to the combustor, a second passage coupling the manifold to the combustor, and an actuator for alternatively selecting the first passage or the second passage.

12. A gas turbine as in claim 11 wherein the first passage is blocked when the second passage is open, and vice versa.

13. A gas turbine as in claim 9 wherein the valve includes a spring bias towards the purge setting.

14. A gas turbine as in claim 8 wherein said external force is pressure from instrument air applied to said actuator.

15. A method for purging a gas turbine having a main compressor providing compressed air to a combustor which generates hot gases to drive a turbine, and the combustor is fueled by a liquid fuel system, wherein the method comprises the steps of:

a. supplying liquid fuel to the combustor and burning the liquid fuel to generate the hot combustion gases, where the liquid is supplied to the combustor through a valve;

b. switching from supplying liquid fuel to the combustor to supplying another type of fuel;

c. purging liquid fuel from the liquid fuel system by directing compressed air via said valve to the combustor, d. switching the valve to pass liquid fuel to the combustor during step (a) by application of liquid fuel pressure to the valve, e. maintaining the valve to pass liquid fuel by application of an external force to the valve, during a high fuel flow condition.

16. A method for purging a gas turbine as in claim 15 wherein the valve is a three-way valve operable in a purge position during step (c) in which purge air passes through the valve to the combustor, and in a fuel position during step (a) in which liquid fuel passes through the valve to the combustor.

17. A method for purging a gas turbine as in claim 15 wherein the valve has a first passage coupling the liquid fuel supply to the combustor, a second passage coupling a purge air manifold to the combustor, and an actuator for alternatively switching the first passage or the second passage.

18. A method for purging a gas turbine as in claim 17 further comprising the steps of blocking the second passage of the valve when the first passage is open, and blocking the first passage of the valve when the second passage is open.

19. A method for purging a gas turbine as in claim 17 wherein the valve includes a default selection of the second passage being open and the first passage being closed, and said method further comprises the step of biasing the valve to open the second passage.

20. A method for purging a gas turbine as in claim 15 wherein said external force is pressure from instrument air applied to said actuator.

21. A method for purging a gas turbine as in claim 15 further comprising the step of removing the external force when the fuel flow reduces from the high flow condition to a low flow condition and thereafter applying liquid fuel pressure to the valve to continue passing liquid fuel through the valve during said low flow condition.

22. A method for supplying liquid fuel and purge air to a combustor of a gas turbine, wherein the combustor is fueled alternatively by a liquid fuel system and a gaseous fuel system and the method comprises the steps of:

a. supplying liquid fuel to the combustor and burning the liquid fuel to generate the hot combustion gases, where the liquid is supplied to the combustor through a valve;

b. switching the valve from supplying liquid fuel to supplying purge air to the combustor by reducing liquid fuel pressure applied to actuate the valve, c. switching the valve from supplying purge air to supplying liquid fuel by increasing liquid fuel pressure applied to actuate the valve, and d. during high liquid fuel flow, applying an external force to the valve to maintain the liquid fuel flow through the valve.

23. A method as in claim 18 wherein the valve is a three-way valve operable in a purge position during step (c) in which purge air passes through the valve to the combustor, and in a fuel switch position during step (a) in which liquid fuel passes through the valve to the combustor.

24. A method as in claim 18 wherein the valve has a first passage coupling the liquid fuel supply to the combustor, a second passage coupling a purge air manifold to the combustor, and an actuator for alternatively selecting the first passage or the second passage.

25. A method as in claim 24 further comprising the steps of blocking the second passage of the valve when the first passage is open, and blocking the first passage of the valve when the second passage is open.

26. A method as in claim 22 wherein the valve includes a default selection of the second passage being open and the first passage being closed.

27. A method as in claim 22 further comprising the step of actively actuating the valve to supply liquid fuel to the combustor by applying an external control signal to the actuator, when a high volume of fuel is flowing to the combustor.

28. A method as in claim 27 where the external signal is instrument air.

29. A method for supplying liquid fuel and purge air to a combustor as in claim 22 wherein said external force is pressure from instrument air applied to said actuator.

30. A method for supplying liquid fuel and purge air to a combustor as in claim 22 further comprising the step of removing the external force when the fuel flow reduces from the high fuel flow to a low flow, and thereafter applying liquid fuel pressure to the valve to hold the valve in a position that continues passing liquid fuel through the valve during said low flow condition.

* * * * *

UNITED STATES PATENT AND TRADEMARK OFFICE

CERTIFICATE OF CORRECTION

PATENT NO. : 6,438,963 B1
DATED : August 27, 2002
INVENTOR(S) : Traver et al.

It is certified that error appears in the above-identified patent and that said Letters Patent is hereby corrected as shown below:

Column 7,
Line 60, replace “umber” with -- number --;

Column 12,
Line 1, replace “18” with -- 22 --; and
Line 6, replace “18” with -- 22 --.

Signed and Sealed this

Twenty-fifth Day of March, 2003

JAMES E. ROGAN
*Director of the United States Patent and Trademark Office*